US005595146A

United States Patent [19]

Bollig et al.

[11] Patent Number: 5,595,146

[45] Date of Patent: Jan. 21, 1997

[54] COMBUSTION ENGINE HAVING A VARIABLE COMPRESSION RATIO

[75] Inventors: Christoph Bollig, Stolberg; Hans-Joerg Hermanns, Würselen; Torsten Schellhase, Herzogenrath; Frank Widmann, Nürnberg, all of Germany

[73] Assignee: FEV Motorentechnik GmbH & Co. Kommanditgesellschaft, Aachen, Germany

[21] Appl. No.: 377,597

[22] Filed: Jan. 24, 1995

[30] Foreign Application Priority Data

Oct. 18, 1994 [DE] Germany ..... 44 37 132.2

[51] Int. Cl.[6] ..... F02B 75/04

[52] U.S. Cl. ..... 123/48 B; 123/78 BA

[58] Field of Search ..... 123/78 BA, 78 E, 123/48 B, 197.4, 197.3

[56] References Cited

U.S. PATENT DOCUMENTS

| | | | |
|---|---|---|---|
| 2,909,164 | 10/1959 | Biermann | 123/48 B |
| 4,131,094 | 12/1978 | Crise | 123/78 E |
| 4,538,557 | 9/1985 | Kleiner et al. | 123/48 B |
| 5,335,632 | 8/1994 | Hefley | 123/78 E |

FOREIGN PATENT DOCUMENTS

| | | | |
|---|---|---|---|
| 0292603 | 11/1988 | European Pat. Off. . | |
| 612405 | 4/1935 | Germany . | |
| 2457208 | 6/1976 | Germany . | |
| 2734715 | 2/1979 | Germany . | |
| 2935977 | 3/1981 | Germany . | |
| 2935073 | 3/1981 | Germany . | |
| 3030615 | 9/1983 | Germany . | |
| 3521626 | 12/1986 | Germany | 123/48 B |
| 3715391 | 11/1991 | Germany . | |
| 4311865 | 10/1993 | Germany . | |

*Primary Examiner*—David A. Okonsky
*Attorney, Agent, or Firm*—Spencer & Frank

[57] ABSTRACT

A combustion engine. The engine includes an engine housing; at least one cylinder disposed in the engine housing; and a crank drive including: a crankshaft having a crank; and a piston being axially displaceable within the cylinder. The crank drive further includes a connecting rod which has an upper connecting rod part hinged to the piston; and a lower connecting rod part hinged to the crank. The lower connecting rod part is hinged to the upper connecting rod part. A central joint hinges the upper connecting rod part and the lower connecting rod part to one another, a longitudinal axis of the upper connecting rod part further being defined by a line connecting the central joint with a hinge joint of the upper connecting rod part to the piston. The engine further includes a hinge point disposed on the engine housing; a control arm hinged at one end thereof to the hinge point, and at another end thereof to the upper connecting rod part; an additional joint for hinging the control arm and the upper connecting rod part to one another disposed adjacent the central joint at a distance from the longitudinal axis of the upper connecting rod part; and a controllable adjusting device connected to the hinge point for changing a distance of the hinge point with respect to the cylinder axis.

16 Claims, 6 Drawing Sheets

COMBUSTION ENGINE HAVING A VARIABLE COMPRESSION RATIO

BACKGROUND OF THE INVENTION

The invention relates to a combustion engine having at least one cylinder and a piston that is displaceable therein, the piston being connected to a crankshaft by way of a connecting rod.

While in normal reciprocating piston driving mechanisms the position of the piston in the cylinder is determined exclusively by the position of the crank, in the past it was attempted to create an option of change for different operating purposes by subdividing the connecting rod into two connecting rod parts connected to one another by way of a central joint, and further hinging a control arm to the connecting rod, the other end of the control arm being secured to the engine housing by means of a displaceable hinge point. Constructions of this type are known from, for example, DE-A-29 35 073, DE-A-29 35 977, DE-A-30 30 615, DE-A-37 15 391. In these constructions the control arm is coupled directly to the central joint, resulting in considerable problems relating to structure and operating technology. The central joint is very wide, and thus has a high weight which can no longer be balanced by counterweights on the crankshaft with the given spatial relations. Furthermore, a construction of this type is known from EP-A-0 292 603 in which the upper connecting rod part has an imaginary extension that extends beyond the central joint and whose end forms the hinge axis for the control arm. Because the distance between the axis of the central joint and the hinging for the control arm must be kept relatively small for the sake of kinematics, the structural problem resulting from the above arrangement can only be solved by means of complicated "interlacing" of the two joints. In addition to the resulting complicated and awkward structure of the joint connections, as represented for the same engine design in DE-A-43 11 865, a further disadvantage that results is that the joint becomes heavier, and the inertial forces become higher. Furthermore, it is difficult to achieve the necessary rigidity with this type of joint configuration. Moreover, this type of joint design has higher friction, which leads to measurable losses of the effective degree of efficiency.

It is known from DE-C-612 405 to hinge the control arm coaxially to the central joint on the connecting rod and to provide this hinging on the lower connecting rod part. It is also known to omit a common central joint of the upper and lower connecting rod parts and to connect the upper and lower connecting rod parts respectively to the control arm by way of a separate joint, as is known from, for example, DE-A-24 57 208 and DE-A-27 34 715. In addition to the kinematic problems of this construction, a high construction expenditure results; particularly when the central joint between the upper and lower connecting rod parts is omitted, very unfavorable stress conditions result for the components of the piston drive formed by the above, particularly for the control arm.

The object of the invention is to avoid the disadvantages with respect to structure and operating technology of the known structural shapes discussed above.

SUMMARY OF THE INVENTION

For a combustion engine having at least one cylinder and a piston that is axially displaceable therein and is connected to a crankshaft by way of a connecting rod which is embodied in two parts and is hinged by its upper connecting rod part to the piston and hinged by its lower connecting rod part to the crank of the crankshaft, the above object is accomplished according to the invention in that the upper connecting rod part and the lower connecting rod part are connected to one another by way of a central joint, and that furthermore a control arm is hinged by one end to the upper connecting rod by way of an additional joint that is disposed in the region of the central joint, at a lateral distance from the longitudinal axis defined by the connecting line between the hinging to the piston and the central joint, with the other end of the control arm being secured to a hinge point on the engine housing which is disposed so as to be displaceable with respect to the cylinder axis. Because the hinging of the control arm to the connecting rod is not effected by way of the central joint, but rather by way of a separate, lateral additional joint, the result is much better kinematics for the piston drive. Moreover, the component stress can be reduced considerably, not least of all because a structurally simpler, narrow and hence lighter design is made possible by the lateral arrangement of the additional joint on the upper connecting rod part. Because of the favorable kinematics, it is possible to compensate the connecting rod mass, which is high in comparison to a normal crank drive, with counterweights on the crankshaft, in which instance the narrow design makes it possible for the additional joint and the central joint to "plunge through" the counterweights in the region of the lower dead center position of the crank. The above arrangement is advantageous in, for example, long-stroke engines. Despite the narrow design, because of the structural separation of the hinging of the control arm from the central joint, a very rigid component connection results, as does a reduction of the friction partners, which is favorable. The longitudinal axis is defined in this case by the connecting line between the hinging to the piston and the central joint.

In a preferred embodiment of the invention, it is provided that, on the upper connecting rod part, the distance between the central joint and the hinging to the piston is at the most equal to, preferably less than, the distance between the additional joint and the hinging to the piston. A number of structural, kinetic and kinematic advantages result from the above, such as, for example, a reduction of the piston height and thus a reduction of the piston mass, lower component accelerations and smaller inertial forces.

In an embodiment of the invention, it is further provided that the crank drive formed by piston, connecting rod and crank is configured such that the cylinder axis does not intersect the axis of the crank. However, it is particularly useful when the crank drive is configured to be offset such that, with respect to the axis of rotation of the crank, the cylinder axis extends on one side and the axis of the hinging of the control arm to the engine housing extends on the other side (negative offset). The result of the above arrangement is smaller normal forces on the piston, so that the piston can also be configured smaller in height. This results in particularly favorable kinematic relationships for the crank drive.

It is particularly useful when the upper connecting rod part and/or the lower connecting-rod part and/or the control arm in an offset embodiment is or are dimensioned such that the axis of the additional joint does not intersect the cylinder axis during a complete crank rotation.

In a further, advantageous embodiment of the invention, it is provided that the central joint is configured in such a way that the joint region of the lower connecting rod part encompasses the joint region of the upper connecting rod part in the manner of a fork. This results in a very rigid but nonetheless narrow joint arrangement.

In a useful embodiment of the invention, it is further provided that the additional joint is also configured in such a way that the joint region of the one element, preferably the control arm, encompasses the joint region of the other element, preferably the upper connecting rod part, in the manner of a fork.

In an embodiment of the invention, it is further provided that the hinge point of the control arm to the engine housing is connected to a controllable adjusting device for changing its distance from the cylinder axis. This arrangement makes it possible to change the dead center positions of the piston, even during operation, and thus to increase or decrease the compression ratio, depending on whether the hinge point is moved in the direction of the cylinder axis (decrease in the compression ratio) or the hinge point is moved away from the cylinder axis (increase in the compression ratio). Because of the above arrangement, it is possible, for example, to decrease the compression ratio in an Otto engine under a full load in order to prevent knocking, but to operate with a higher compression ratio under a partial load in order to maintain a good efficiency.

In an advantageous embodiment of the invention, it is provided that the hinge point of the control arm to the engine housing is essentially seated transversely to the cylinder axis, and a support element which can be changed in length is provided as an adjusting device; by means of this support element, the hinge point is held in a respectively predeterminable position, and the support element is connected to adjusting means, which permits displacement after operation of the adjusting means under the influence of the forces of the crank drive. This arrangement has the advantage that no additional adjusting forces need to be exerted to displace the hinge point during an adjustment; rather, only the adjusting means of the activatable adjusting device needs to be activated, and it then makes possible a displacement of the hinge point by a predeterminable amount under the influence of the inertial forces.

In a particularly useful embodiment of the invention, it is provided that the support element is formed by a dual-acting piston-cylinder arrangement that is charged with a liquid pressure medium, and in which the two cylinder ends are connected to one another by way of a bypass line, in which an activatable valve is disposed as an adjusting means. Depending on the opening via the activatable valve, the support element can then be moved in the direction of one or the other cylinder end under the influence of the forces of the piston drive. However, it is possible in the same way to move the support element back and forth via oil pressure instead of a force effect by inertial forces.

In a further advantageous embodiment, a crank is provided whose crank journal forms the hinge point of the control arm, and whose crankshaft is connected to the support element by way of a transmission element. This arrangement permits the necessary movement of the hinge point of the control arm transversely to the cylinder axis by means of a rotational movement. A further advantage is the possibility of corresponding transmission ratios in order to generate a very sensitive and very precise transverse movement of the hinge point. In a corresponding embodiment of the transmission element, it is likewise possible to convert an axial movement, as is permitted by piston-cylinder arrangement, into a rotational movement. This is possible, for example, when the crankshaft is provided with a relatively steep, helical outer gearing that is guided in a corresponding inner gearing of a piston that is charged on alternating sides. The degree of pitch determines the relationship between the path of displacement of the piston on the one hand and the rotational movement of the crank on the other hand, so that very small rotations of the crank and thus very slight transverse displacements of the hinge point can be achieved by means of long piston strokes. The displacement can either be effected actively by the pressure medium charging the piston, or by means of the forces initiated by the crank. In the latter case, however, it is necessary for the pitch of the gearing to be dimensioned such that no self-locking takes place.

BRIEF DESCRIPTION OF THE DRAWINGS

The invention is explained in detail by way of schematic drawings of embodiments. Shown are in.

DETAILED DESCRIPTION OF THE INVENTION

The efficiency in a reciprocating piston combustion engine, particularly an Otto engine, can be significantly improved by the adaptation of the compression ratio to the respective load state. If the constant volume cycle is chosen as the cyclic process model for the Otto engine, the result for the thermal efficiency is $$\eta_{th,V} = 1 - \frac{1}{\epsilon^{\kappa-1}}$$

$\eta_{th,V}$ thermal efficiency of the constant volume cycle
$\kappa$ isentropical exponent
$\epsilon = V_h/V_c + 1$ compression ratio
$V_h$ cylinder stroke volume
$V_c$ compression volume As one can see from the definition of thermal efficiency, efficiency increases with an increasing compression ratio.

Because of the knocking tendency of the Otto engine under full load, however, the compression ratio must be limited for full-load operation. A compression ratio limited in this way and matched to full-load operation is, however, normally too low for the attainment of good efficiencies in partial-load operation. Supercharging Otto engines, which can be performed to increase the output density, further intensifies this conflict of objectives. On the one hand, the supercharging of the compression ratio that is necessary for the desired increased power density must be reduced with respect to the freely-aspirating Otto engine in order to prevent knocking combustion. On the other hand, the discrepancy between the actual compression ratio and the high compression ratio necessary for good efficiency is correspondingly larger under the partial load. This conflict of objectives in Otto engines can be avoided by a load-dependent adaptation of the compression ratio that can be performed during operation.

The problem facing highly-supercharged diesel engines is that the compression ratios, which are high in principle because of the limitation of the peak pressure, must be reduced with respect to the non-supercharged diesel engine. If it is desired to achieve an increase in power by means of this increase in the supercharge, the compression ratio must be reduced even more noticeably. However, this can only go so far as to continue to assure the compression ratio necessary for reliable starting of the diesel engine. The above also offers a changeable compression ratio.

To summarize, the variable compression ratio is of great significance for the freely-aspirating combustion engine as well as the supercharged combustion engine with respect to an increase in efficiency as compared to the conventional engine.

A design for a reciprocating piston engine is illustrated below and described by way of an embodiment; this engine permits an adjustment of the compression ratio that is controlled by a performance graph and in which the piston capacity is virtually constant.

Figure 1:
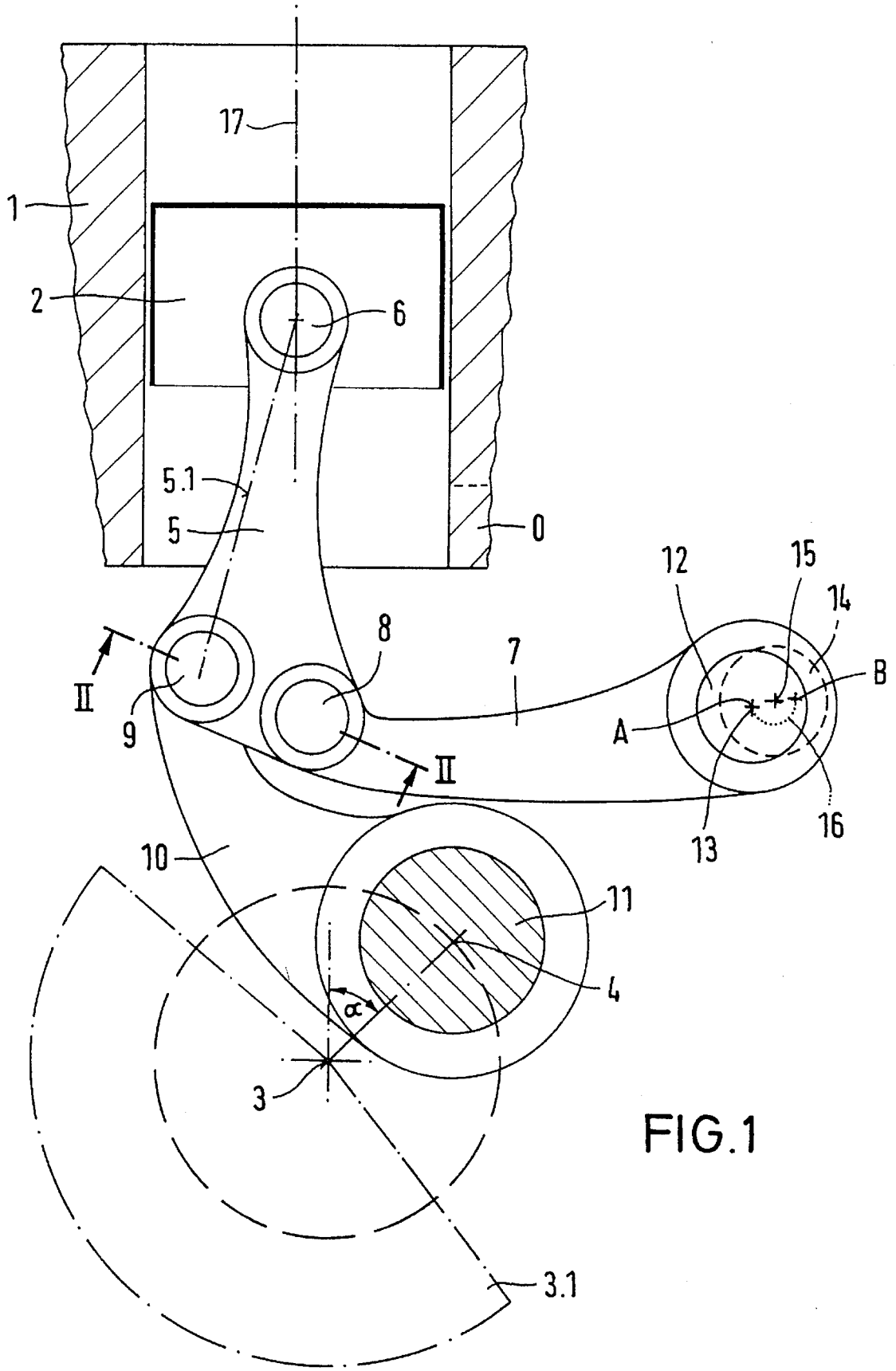
FIG. 1 a vertical cross-section through a cylinder of a reciprocating piston engine, FIG. 2 a section along line II—II in FIG. 1, FIG. 3 an embodiment for an adjusting mechanism, FIG. 4 a block diagram for activating the adjusting mechanism according to FIG. 3, FIG. 5 a further activation option for the adjusting mechanism, FIG. 6 the course of the resulting torque of a four-cylinder engine as a function of the crank angle and in relation to the gas pressure of the first cylinder, FIGS. 7(*a*)–7(*d*) the kinematics of the crank drive in different crank positions.

As FIG. 1 shows, the reciprocating combustion engine includes a cylinder 1, in which a piston 2 can move up and down. The connecting rod is subdivided into an upper connecting rod part 5 and a lower connecting rod part 10, with the upper connecting rod part 5 being hinged to the piston 2 in a conventional manner by way of a piston pin 6. The lower connecting rod part 10 is hinged to the crank journal 11 of the crank 4 on the crankshaft 3. The upper connecting rod part 5 and the lower connecting rod part 10 are connected to one another by means of a central joint 9. The longitudinal axis 5.1 of the upper connecting rod part 5 is defined by the connecting line between the axis of the piston pin 6 and the axis of the central joint 9.

Furthermore, the upper connecting rod part 5 has an additional joint 8 in the region of the central joint 9; this additional joint is disposed at a lateral distance from the longitudinal axis 5.1 of the upper connecting rod part 5. Hinged to this additional joint 8 is a control arm 7, which is hinged by its other end to a hinge point 13 in the form of an eccentric 12. The eccentric 12 and thus the hinge point 13 are connected to an eccentric shaft 14, so that when the eccentric shaft 14 is rotated about the axis 15 fixed to the housing, on the circular path 16 indicated by a dotted line and lying in the plane of rotation of the crank 4, the hinge point 13 can move between position A and position B, essentially transversely to the cylinder axis 17.

Because of the indicated displacement of the eccentric, and thus a displacement between position A and position B of the hinge point 13 fixed to the housing, an increase or a decrease in the compression ratio results due to the overall kinematic connection of the represented variable crank drive. A reduction in the compression ratio with a virtually constant volume is achieved when the piston 2 assumes a correspondingly lower, vertical height in the upper dead center position, measured from the axis of crankshaft 3, than with the maximum possible compression ratio. The lower dead center is displaced downward by nearly the same amount.

The design illustrated in FIG. 1 exhibits another particular structural feature. The illustrated crank drive has a so-called negative offset, i.e., the cylinder axis 17 lies on the left in the drawing, and the additional joint 9 of the control arm 7 lies to the right of the vertical center plane defined by the axis of crankshaft 3. This arrangement causes clearly lower normal forces on the piston, which has a favorable effect with regard to wear and friction. Because of the reduced surface pressure between piston 2 and cylinder 1, the friction surface of the piston skirt can be reduced, which again leads to a reduction in the piston mass and hence to a decrease in the inertial forces of the crank drive. The engine block can be more compact with negative offset, because the distance between hinge point 13 and the center of crankshaft 3, which is perpendicular to the cylinder axis 17, is narrowed.

In this instance, it is also possible to provide a recess 0 in the cylinder liner in order to assure floating of the crank drive in a correspondingly more compact design. In the structure of the control arm 7, the result of this recess 0 is greater clearance, which is very helpful with regard to the mechanical stress of the control arm 7. The recess 0 is just wide enough for the shaft of the control arm to dip in collision-free. The oil control ring of the piston 2 does not pass across this recess.

Figure 2:
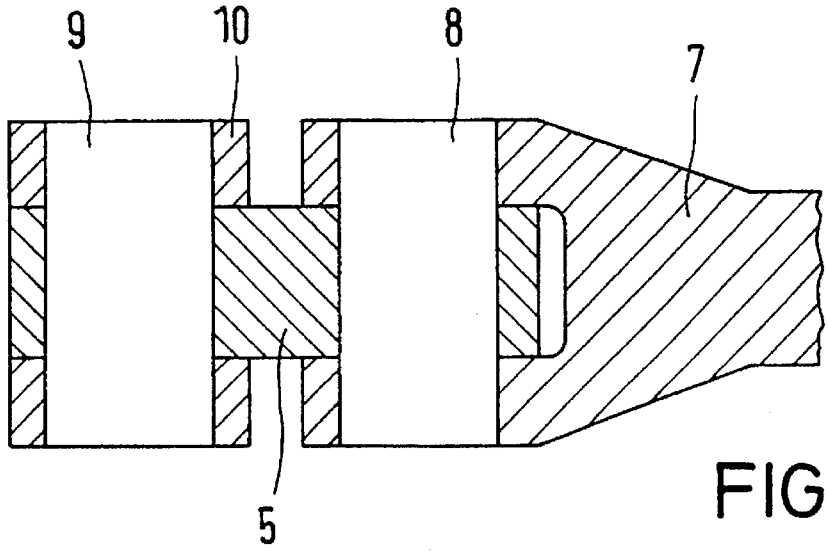

A cross-section along lines II—II through the lower end of the upper connecting rod part 5 is shown in FIG. 2. It can be seen from the sectional representation that the upper end of the lower connecting rod part 10 is configured in a fork shape, for both the central joint 9 and the additional joint 8, so that the upper connecting rod part 5 is correspondingly encompassed on the one side and the control arm 7 on the other. This type of arrangement is very narrow, results in low-friction and is moreover highly resistant to bending. As can readily be seen from FIG. 1 and the schematic representation of the kinematics in FIG. 7, the joint arrangement of the upper connecting rod part 5 and the adjoining part of the control arm 7 "plunge through" between the counterweights 3.1 indicated in FIG. 1 because of the narrow design, so that a mass compensation is possible for each cylinder.

Figure 3:
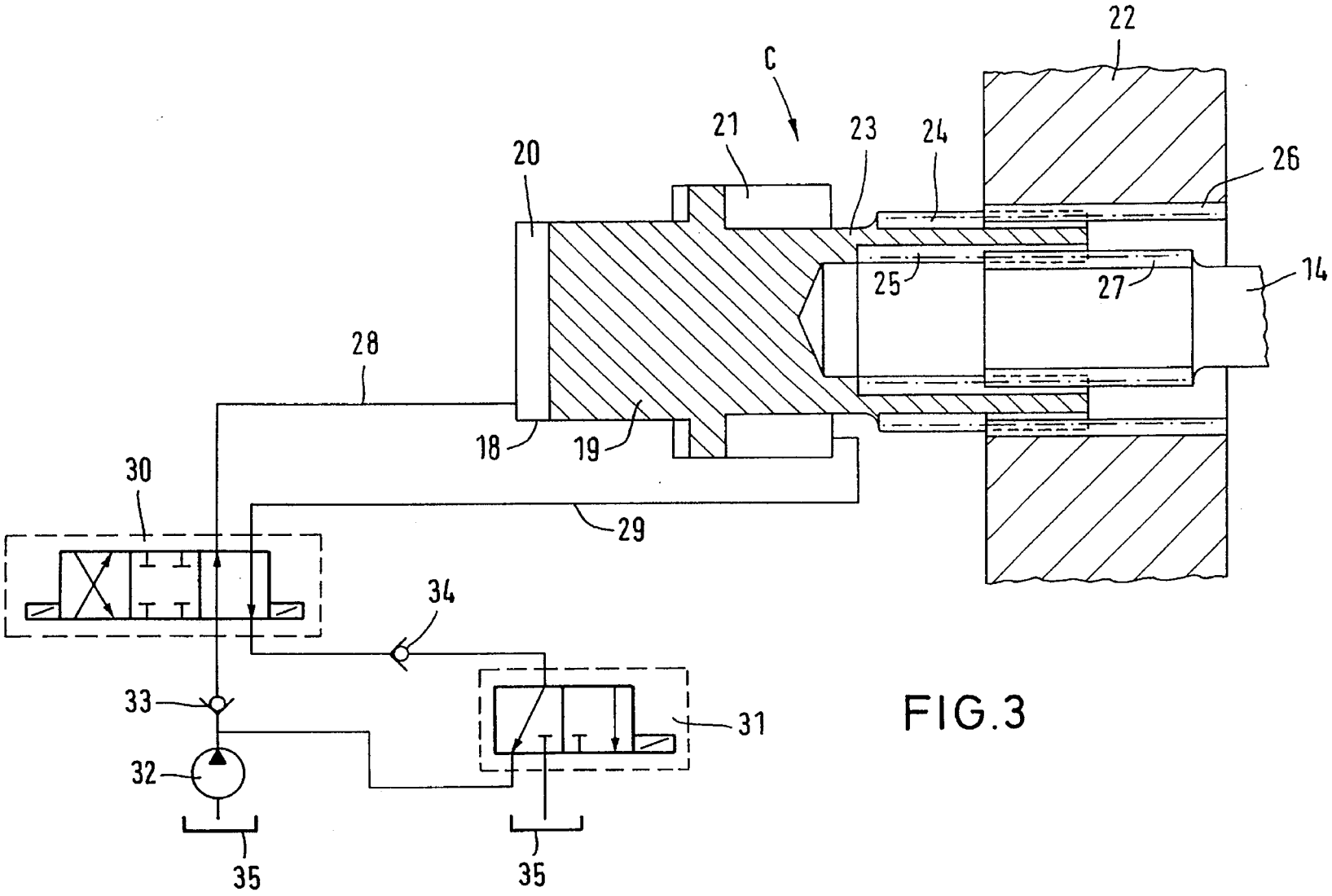

An embodiment of a support element for the housing-side hinge point 13 of the control arm 7, the element being configured as an adjusting device C, is illustrated in FIG. 3. This element essentially comprises a hydraulic cylinder 18 and a piston 19 which is axially displaceable therein and has on its side that faces the eccentric shaft 14 a tube-like extension 23, which is provided with an outer spiral gearing 24 and an inner spiral gearing 25. The outer spiral gearing 24 engages an inner spiral gearing 26 secured to the crankcase 22. The inner spiral gearing 25 of the piston extension 23 engages the outer spiral gearing 27 of the eccentric shaft 14. The two compressed oil chambers 20 and 21 in the cylinder 18 are sealed against one another by the piston 19 and charged with compressed oil via the compressed oil lines 28 and 29. An axial displacement of the hydraulic piston, the direction of which is established between the two compressed oil chambers 20 and 21 as a function of the pressure dropoff, leads to a rotation of the eccentric shaft 14, which in turn leads to a movement of the hinge point 13 on its circular path 16 between points A and B.

In straight-line multicylinder engines, the eccentric shaft 14 is operated only by the kind of adjusting mechanism that is connected to one end of the eccentric shaft 14, on which a number of eccentrics or cranks (such as eccentric 12) corresponding to the number of cylinders is disposed.

Rotation of the eccentric shaft 14 may be achieved at any time by holding the hydraulic piston in arbitrary intermediate positions between the compressed oil chambers 20 and 21 by means of pressure compensation. For this purpose, proportional valves 30, 31 are used which seal the compressed oil lines 28 and 29 or, during a desired displacement of the hydraulic oil piston 19, can open them, depending on the necessary direction of displacement. A check valve 33 prevents a displacement of the hydraulic piston counter to the desired direction of displacement because of restoring torques occurring on the eccentric shaft 14. The flow-through direction of the two proportional valves 30 and 31 is determined with a check valve 34.

The oil circulation of the adjusting mechanism can be integrated into the engine oil circulation. In this case, the necessary oil pump 32 would be identical to the engine oil pump. The oil reservoir 35 would correspond to the engine oil pan. As an alternative to this, the oil circulation illustrated in FIG. 3 can also be configured as an independent compressed oil circulation.

Figure 4:
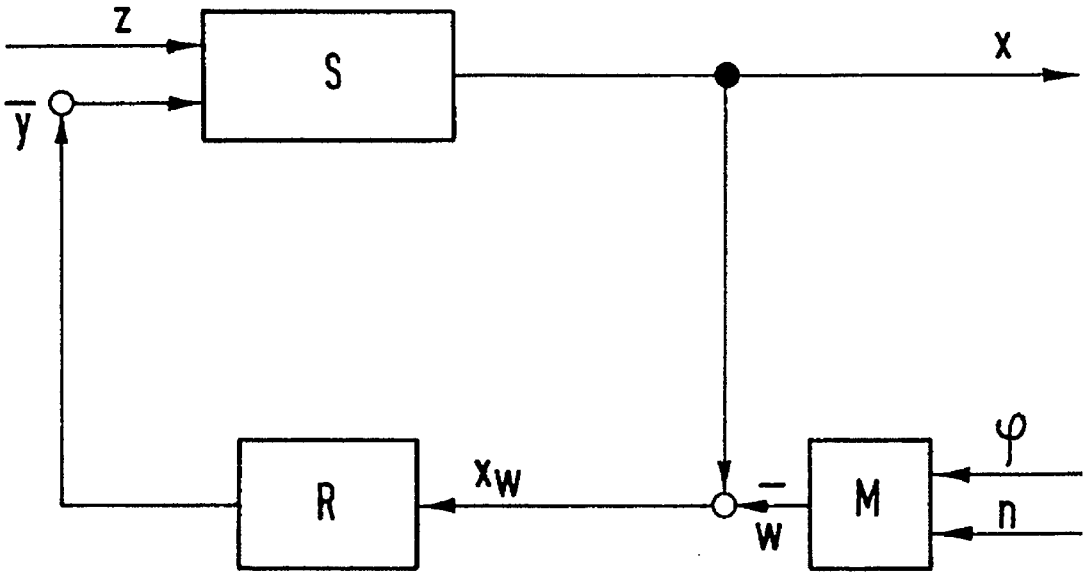

The displacement of the hydraulic piston 19 is controlled by a control system shown as a block diagram in FIG. 4; the performance graph values "load," determined by the throttle position $\phi$, and rpm "n" represent values for the control system which are further processed to form a nominal value (guidance variable) of the position of the hinge point 13 with the aid of a measured-value recorder M.

Figure 6:
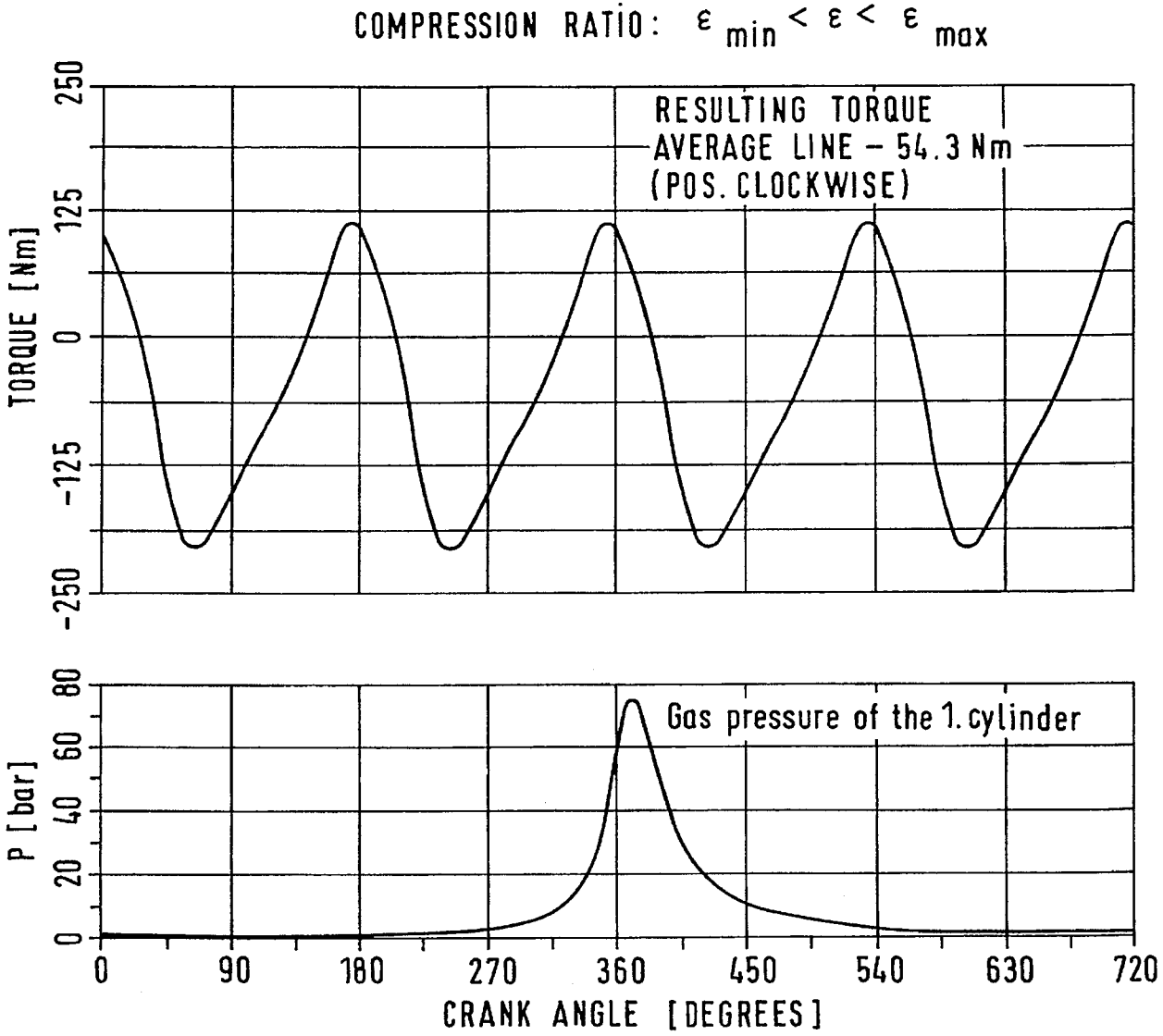
Figure 7A:
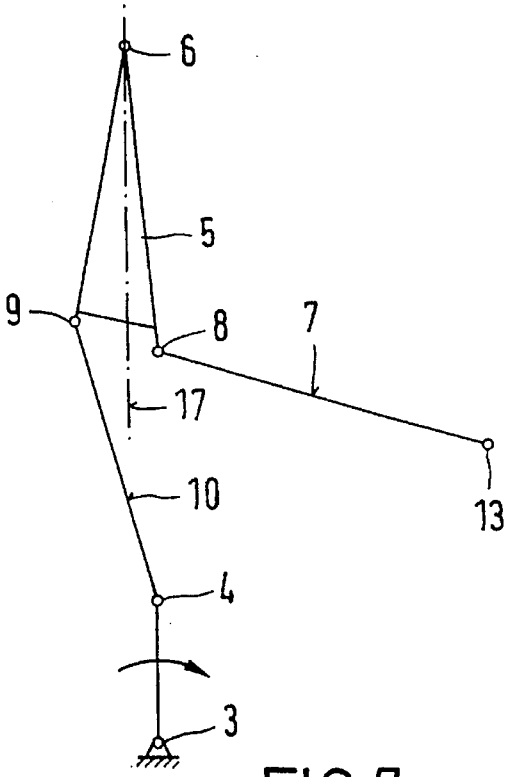
Figure 7B:
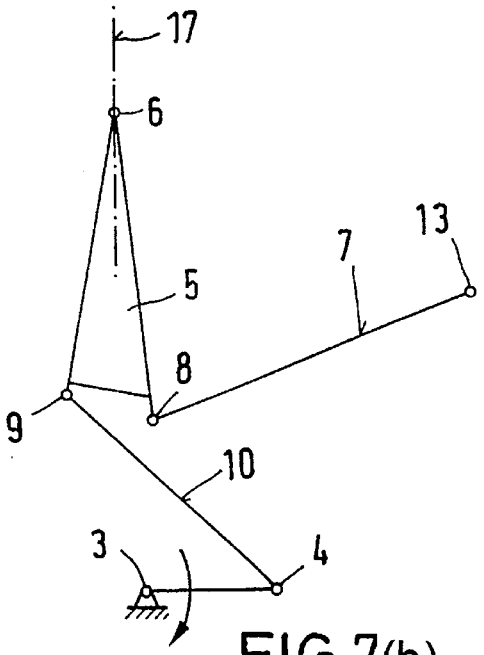
Figure 7D:
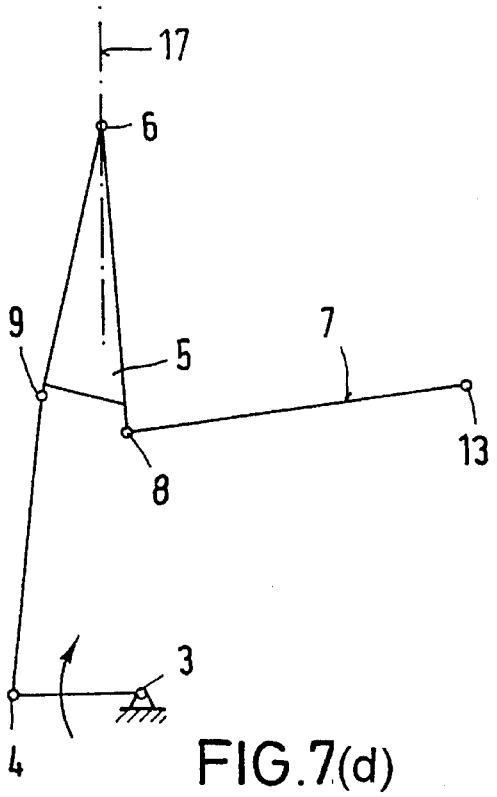
Figure 7C:
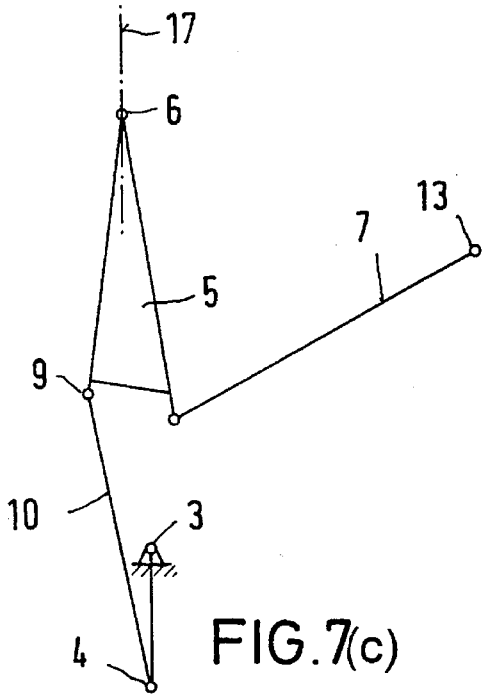

The forces of the crank drive, which represent an interference variable for the control system in the form of a torque (see FIG. 6), act on the adjusting mechanism and lead to a control deviation $x_w$, which is in turn taken into consideration by the controller during determination of the adjustment value y, as can be seen from FIG. 4. Because the resulting torque rotates clockwise about the eccentric shaft 14 due to the internal forces of the crank drive and the gas force acting on the piston 2, the adjusting mechanism has the tendency to move the hinge point 13 into position A illustrated in FIG. 1, which corresponds to the smallest possible compression. This represents a special protective function during a sudden load change from partial load to full load, because the compression ratio can be adjusted more quickly to smaller values with the aid of the resulting torque of the crank drive in order to prevent peak pressures or knocking, which can damage the engine.

The compression ratio can thus be adjusted between a low compression during a full load and a maximum compression during an extreme partial load. In this case, the hinge point 13 is moved in the following manner:

The hinge point is under full load in position A, as shown in FIG. 1. The compression ratio can be increased if the load is reduced. This occurs by means of a rotation of the eccentric shaft 14, so that the hinge point 13 moves out of position A in the direction of position B on the circular path 16. In an extreme partial load, or at very low rpm in supercharged combustion engines, the hinge point 13 is located in position B, i.e., the combustion engine is then operated with the highest compression ratio.

Figure 5:
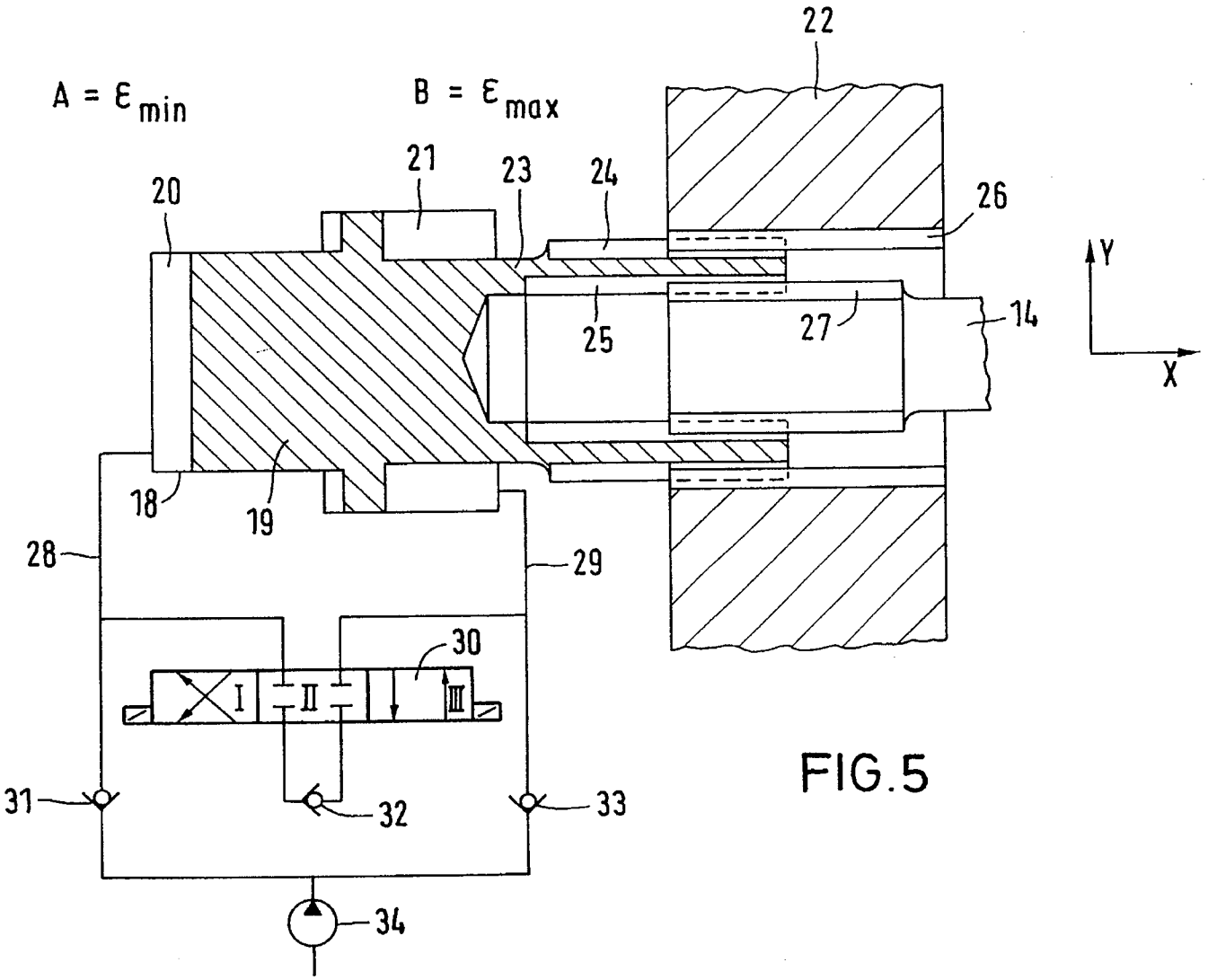

Whereas a force-operated adjusting mechanism C was illustrated and described by way of FIG. 3, FIG. 5 shows an arrangement which permits automatic adjustment, i.e., adjustment without additional adjusting forces. The torque (see FIG. 6) exerted on the eccentric shaft 14, which results from the inertial forces of the crank drive and the gas force, represents the force potential for the displacement of the hinge point 13. During a rotation of the eccentric shaft 14, the hydraulic piston 19 is displaced axially into the lowest possible compression corresponding to position A, or into the highest possible compression corresponding to position B. The negative components of the torque on the eccentric shaft 14 (as can be seen from FIG. 6) effect a rotation of the eccentric shaft 14 in the positive clockwise direction when seen in the direction of the positive X-axis (see the coordinate information in FIG. 5). The hydraulic piston 19 moves into position III of the proportional valve 30, in the negative X-direction, that is, in the direction of the lowest compression corresponding to position A, with corresponding spiral gearing pairings 24/26 and 25/27. In this position of the proportional valve 30, the positive components of the torque cannot displace the hydraulic piston 19 in the opposite direction, because the check valve 32 impedes a flow-through direction of the proportional valve 30 that is necessary for this displacement. It has proven particularly advantageous that the negative components of the torque on the eccentric shaft 14 are greater than the positive components of the torque on the eccentric shaft 14, because during a sudden load change from partial load to full load, this means that the compression ratio can be changed correspondingly quickly from a high compression ratio to a low compression ratio. Thus, knocking damage in an Otto engine, and an overload of the components caused by peak pressure in a diesel engine, can be prevented.

If the hinge point 13 is supposed to be moved in such a way that greater compression ratios are established, the hydraulic piston 19 must travel in the positive X-direction. This requires position I of the proportional valve 30, in which only the effect of the positive components of the torque is allowed on the eccentric shaft.

Position II of the proportional valve 30 permits a constant compression ratio. Neither the negative nor the positive components of the torque on the eccentric shaft 14 can change the position of the hinge point 13 or the hydraulic piston 19. The incompressibility of the hydraulic oil and a corresponding non-deformability of the hydraulic components and of the compressed oil conduits are prerequisites.

In this embodiment, the oil pump 34 of the engine only takes over the task of compensating possible leakage losses. The check valves 31 and 33 prevent a short circuit of the respective hydraulic switching position.

The kinematics of the crank drive shown in FIG. 1 and described above is shown in FIGS. 7(*a*) through 7(*d*) for a clockwise rotation of the crankshaft from a 0° to a 270° crank angle. In the given design, the distance of the central joint 9 from the hinging of the upper connecting rod part 5, which is defined by the crank journal 6, is smaller than the distance of the additional joint 8 from the hinging of the upper connecting rod to the piston 2. It is advisable for the distance ratio to be 8-6 to 9-6, in any case greater than 1, in order to limit the acceleration values of the crank drive, and thus the inertial forces. If the ratio assumes 8-6 to 9-6 values less than 1, the peak values of the component acceleration or the inertial forces of the crank drive increase dramatically. The distance between the central joint 9 and the additional joint 8 must be selected such that, on the one hand, floating of the upper connecting rod part 5 in the cylinder 1 is assured and, on the other hand, that sufficient space is available to dispose the two joints 8 and 9 with respect to each other such that the control arm 7, the lower connecting rod part 10 and the upper connecting rod part 5 can move collision-free in one plane.

The adjusting mechanism described by way of FIGS. 3 and 5 can also be modified to the effect that the hinge point 13 is supported directly on one end of a hydraulic piston whose direction of movement, however, then extends in the direction of the cylinder axis 17, transversely to the crankshaft 3, so that the displacement of the piston directly effects a displacement of the hinge point 13.

List of Reference Numerals for FIG. 4:

$\phi$—throttle position

M—measured-value recorder n—engine rpm

R—controller

S—adjusting mechanism (adjusting element)

w—nominal value of the hinge point position (guidance variable)

x—actual value of the hinge point position (control variable)

$x_w$—control deviation y—adjustment variable z—hinge point displacement by means of forces of the crank drive (interference variable)

We claim:

1. A combustion engine comprising:

an engine housing;

at least one cylinder disposed in the engine housing and having a cylinder axis;

a crank drive including:

a crankshaft having a crankshaft axis and a crank and being disposed adjacent the cylinder;

a piston being axially displaceable within the cylinder;

a connecting rod including:

an upper connecting rod part hinged to the piston;

a lower connecting rod part hinged to the crank of the crankshaft, the lower connecting rod part further being hinged to the upper connecting rod part; and a central joint for hinging the upper connecting rod part and the lower connecting rod part to one another, a longitudinal axis of the upper connecting rod part further being defined by a line connecting the central joint with a hinge joint of the upper connecting rod part to the piston;

a hinge point having a hinge point axis and being disposed on the engine housing;

a control arm hinged at one end thereof to the hinge point, and at another end thereof to the upper connecting rod part;

an additional joint for hinging the control arm and the upper connecting rod part to one another, the additional joint having an additional joint axis and being disposed adjacent the central joint at a distance from the longitudinal axis of the upper connecting rod part; and a controllable adjusting device connected to the hinge point for changing a distance of the hinge point with respect to the cylinder axis in a direction transverse to the cylinder axis, the controllable adjusting device including:

a support element connected to the hinge point and having a changeable length for keeping the hinge point in various ones of predeterminable positions; and an adjusting means connected to the support element and responsive to a torque resulting from inertial forces of the crank drive for changing a length of the support element for moving the hinge point into one of its predeterminable positions.

2. A combustion engine comprising:

an engine housing;

at least one cylinder disposed in the engine housing and having a cylinder axis;

a crank drive including:

a crankshaft having a crankshaft axis and a crank and being disposed adjacent the cylinder;

a piston being axially displaceable within the cylinder;

a connecting rod including:

an upper connecting rod part hinged to the piston;

a lower connecting rod part hinged to the crank of the crankshaft, the lower connecting rod part further being hinged to the upper connecting rod part; and a central joint for hinging the upper connecting rod part and the lower connecting rod part to one another, a longitudinal axis of the upper connecting rod part further being defined by a line connecting the central joint with a hinge joint of the upper connecting rod part to the piston;

a hinge point having a hinge point axis and being disposed on the engine housing;

a control arm hinged at one end thereof to the hinge point, and at another end thereof to the upper connecting rod part;

an additional joint for hinging the control arm and the upper connecting rod part to one another, the additional joint having an additional joint axis and being disposed adjacent the central joint at a distance from the longitudinal axis of the upper connecting rod part; and a controllable adjusting device connected to the hinge point for changing a distance of the hinge point with respect to the cylinder axis, the controllable adjusting device including:

a support element connected to the hinge point and being effective for keeping the hinge point in various ones of predeterminable positions, the support element including:

a dual acting piston-cylinder arrangement adapted to be charged by a liquid pressure medium and including a support element cylinder having two ends and a support element piston disposed within the support element cylinder;

a bypass line containing the liquid pressure medium and connecting the two ends of the support element cylinder to one another for moving the support element piston within the support element cylinder; and an adjusting means connected to the support element for moving the hinge point into one of its predeterminable positions, the adjusting means including a valve disposed in the bypass line.

3. The combustion engine according to claim 1, wherein:

the hinge point comprises an eccentric having a crank journal;

the support element includes a shaft connected to the crank journal of the eccentric; and the adjusting means includes a transmission element for moving the shaft.

4. The combustion engine according to claim 2, wherein:

the hinge point comprises an eccentric having a crank journal;

the support element includes a shaft connected to the crank journal of the eccentric; and the adjusting means includes a transmission element for moving the shaft.

5. The combustion engine according to claim 1, wherein a distance between the central joint and the hinge joint of the upper connecting rod part to the piston is less than or equal to a distance between the additional joint and the hinge joint of the upper connecting rod part to the piston.

6. The combustion engine according to claim 2, wherein a distance between the central joint and the hinge joint of the upper connecting rod part to the piston is less than or equal to a distance between the additional joint and the hinge joint of the upper connecting rod part to the piston.

7. The combustion engine according to claim 1, wherein the cylinder and the crank drive are disposed such that the cylinder axis does not intersect the crankshaft axis, the cylinder and the crank drive thereby being offset with respect to one another.

8. The combustion engine according to claim 2, wherein the cylinder and the crank drive are disposed such that the cylinder axis does not intersect the crankshaft axis, the cylinder and the crank drive thereby being offset with respect to one another.

9. The combustion engine according to claim 1, wherein the cylinder, the crank drive and the hinge point are disposed such that the cylinder axis extends on one side of the crankshaft axis, and the hinge point axis extends on another side of the crankshaft axis, the cylinder, the crank drive and the hinge point thereby being negatively offset with respect to one another.

10. The combustion engine according to claim 2, wherein the cylinder, the crank drive and the hinge point are disposed such that the cylinder axis extends on one side of the crankshaft axis, and the hinge point axis extends on another side of the crankshaft axis, the cylinder, the crank drive and the hinge point thereby being negatively offset with respect to one another.

11. The combustion engine according to claim 1, wherein at least one of the upper connecting rod part, the lower connecting rod part and the control arm is dimensioned such that the additional joint axis does not intersect the cylinder axis during a complete crank rotation.

12. The combustion engine according to claim 2, wherein at least one of the upper connecting rod part, the lower connecting rod part and the control arm is dimensioned such that the additional joint axis does not intersect the cylinder axis during a complete crank rotation.

13. The combustion engine according to claim 1, wherein the central joint includes a joint region of the upper connecting rod part and a joint region of the lower connecting rod part, one of the joint regions encompassing another one of the joint regions in the manner of a fork.

14. The combustion engine according to claim 2, wherein the central joint includes a joint region of the upper connecting rod part and a joint region of the lower connecting rod part, one of the joint regions encompassing another one of the joint regions in the manner of a fork.

15. The combustion engine according to claim 1, wherein the additional joint includes a joint region of the upper connecting rod part and a joint region of the control arm, one of the joint regions encompassing another one of the joint regions in the manner of a fork.

16. The combustion engine according to claim 2, wherein the additional joint includes a joint region of the upper connecting rod part and a joint region of the control arm, one of the joint regions encompassing another one of the joint regions in the manner of a fork.

* * * * *